US009938490B2

(12) United States Patent
Walsh et al.

(10) Patent No.: US 9,938,490 B2
(45) Date of Patent: Apr. 10, 2018

(54) SYSTEMS AND METHODS FOR TABLETIZED TUBE CLEANING

(71) Applicant: Crossford International, LLC, Stamford, CT (US)

(72) Inventors: Dave Walsh, Stamford, CT (US); Timothy J. Kane, Stamford, CT (US); Ray Field, Stamford, CT (US); Joseph J. Franzino, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 0 days.

(21) Appl. No.: 14/830,774

(22) Filed: Aug. 20, 2015

(65) Prior Publication Data

US 2016/0257913 A1 Sep. 8, 2016

Related U.S. Application Data

(63) Continuation of application No. PCT/US2015/045909, filed on Aug. 19, 2015.

(Continued)

(51) Int. Cl.

| | |
|---|---|
| ***C11D 17/00*** | (2006.01) |
| ***B08B 1/04*** | (2006.01) |
| ***B08B 3/08*** | (2006.01) |
| ***B08B 9/027*** | (2006.01) |
| ***C11D 3/00*** | (2006.01) |
| ***C11D 3/10*** | (2006.01) |
| ***C11D 3/20*** | (2006.01) |
| ***C11D 11/00*** | (2006.01) |

(Continued)

(52) U.S. Cl.

CPC ..... *C11D 17/0047* (2013.01); *B08B 1/04* (2013.01); *B08B 3/08* (2013.01); *B08B 9/027* (2013.01); *B08B 9/045* (2013.01); *B08B 9/0436* (2013.01); *C11D 3/0052* (2013.01); *C11D 3/0073* (2013.01); *C11D 3/10* (2013.01); *C11D 3/2086* (2013.01); *C11D 11/0041* (2013.01); *F28G 9/00* (2013.01); *C11D 7/12* (2013.01); *C11D 7/265* (2013.01)

(58) Field of Classification Search

CPC .. B08B 1/04; B08B 3/08; B08B 9/027; C11D 3/0073; C11D 3/10; C11D 3/2086; C11D 17/0047

USPC ..... 134/6, 8, 22.1, 22.11, 22.13, 22.14, 134/22.16, 22.17, 22.19, 93, 166 C

See application file for complete search history.

(56) References Cited

U.S. PATENT DOCUMENTS

| | | |
|---|---|---|
| 7,055,203 B1 | 6/2006 | Franzino |
| 8,361,942 B2 | 1/2013 | Smith et al. |

(Continued)

FOREIGN PATENT DOCUMENTS

| | | |
|---|---|---|
| WO | WO 0042148 | 7/2000 |
| WO | WO 2014029819 | 2/2014 |

OTHER PUBLICATIONS

International Search Report for PCT/US2015/045909 dated Dec. 10, 2015; 2 pps.

(Continued)

*Primary Examiner* — Michael E Barr
*Assistant Examiner* — Levon J Shahinian
(74) *Attorney, Agent, or Firm* — Carson C. K. Fincham; Fincham Downs LLC

(57) ABSTRACT

Systems and methods for formulating, tabletizing, and utilizing cleaning tablets, particularly with respect to tube cleaning operations.

20 Claims, 3 Drawing Sheets

Related U.S. Application Data

(60) Provisional application No. 62/128,810, filed on Mar. 5, 2015.

(51) Int. Cl.

| | |
|---|---|
| ***B08B 9/043*** | (2006.01) |
| ***B08B 9/045*** | (2006.01) |
| ***F28G 9/00*** | (2006.01) |
| *C11D 7/12* | (2006.01) |
| *C11D 7/26* | (2006.01) |

(56) References Cited

U.S. PATENT DOCUMENTS

| | | | | |
|---|---|---|---|---|
| 2007/0298991 | A1 | 12/2007 | Longo | |
| 2008/0063774 | A1 | 3/2008 | Aehle et al. | |
| 2009/0148342 | A1 | 6/2009 | Bromberg et al. | |
| 2010/0003384 | A1* | 1/2010 | Iacovone | A23L 2/40 426/285 |
| 2011/0027252 | A1 | 2/2011 | Aehle et al. | |
| 2011/0139818 | A1 | 6/2011 | Kessler et al. | |
| 2012/0111743 | A1 | 5/2012 | Kramer et al. | |
| 2013/0239313 | A1 | 9/2013 | Schiedel et al. | |
| 2013/0239991 | A1 | 9/2013 | Denvir et al. | |
| 2014/0038270 | A1 | 2/2014 | Friis et al. | |

OTHER PUBLICATIONS

Written Opinion for PCT/US2015/045909 dated Dec. 10, 2015; 3 pps.

* cited by examiner

SYSTEMS AND METHODS FOR TABLETIZED TUBE CLEANING

CROSS-REFERENCE TO RELATED APPLICATIONS

The present application claims benefit and priority under 35 U.S.C. § 120 to, and is a continuation of, International Patent Application PCT/US15/45909 filed on Aug. 19, 2015, which itself claims benefit and priority under 35 U.S.C. § 119(e) to, and is a non-Provisional of, U.S. Provisional Patent Application No. 62/128,810, filed on Mar. 6, 2015 and titled "PORTABLE TUBE CLEANING SYSTEM", the entirety of which is hereby incorporated by reference herein.

TECHNICAL FIELD

The present application generally relates to tabletized tube cleaning formulations and methods and apparatus for periodically cleaning the interior surfaces of heat-exchanging systems comprising a plurality of fluid-conveying tubes.

BACKGROUND

Air conditioning and industrial chilling systems are typically configured with arrays of chiller tubes. Boilers and other commercial or industrial equipment also may include fluid-conveying tubes to provide various heat exchange functionalities. All of such tubes must be serviced periodically to prevent or reduce internal fouling and corrosion, and such servicing typically involves utilization of both mechanical and fluid treatment on the interior surfaces of the tubes. The fluid treatment itself typically includes application of chemical cleaners and/or inhibitors. In some cases, different tools may be utilized for each of mechanical agitation, chemical application, and powered fluid cleaning or washing. While some tools available in the industry provide combined solutions that integrate mechanical agitation and powered fluid washing, such tools and solutions may suffer from various deficiencies.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Figure 1:
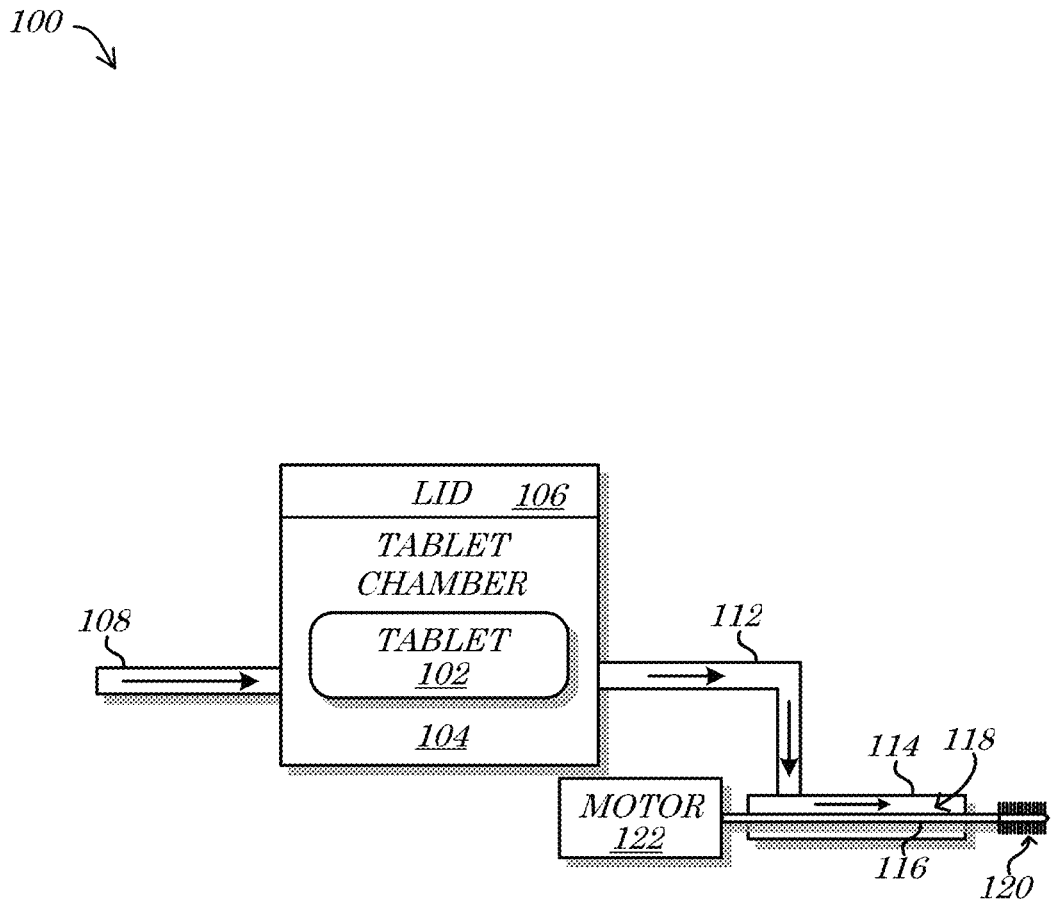
FIG. 1 is block diagram of a system according to some embodiments.

Embodiments described herein generally relate to effervescing solid tablets for use in connection with tube cleaning operations and to systems and methods for utilizing such tablets to effectuate cleaning activities (e.g., of chiller tubes). In some embodiments, such cleaning tablets may comprise at least one effervescing agent, a biofilm disrupter, and corrosion inhibitor, that effervesce and dissolve in a carrier fluid, which may comprise aqueous, organic, or any combination of aqueous and organic components (e.g., water), to make cleaning fluids, and systems and methods of making and using the solid tablet thereof.

An effervescing solid tablet, in accordance with some embodiments, may be formulated with ingredients that may be pressed into a solid form, such as a tablet. According to some embodiments, the physical state of ingredients comprising a solid tablet may be solid, semi-solid or liquid at ambient temperature, so long as the combination of these ingredients may be pressed into a solid tablet that may retain a desired shape at ambient temperature.

The ingredients of a solid tablet, in accordance with some embodiments, may be pressed into any number of shapes and sizes. For example, in some embodiments, it may be useful for a solid tablet to have a relatively high surface area to volume ratio to allow for faster dissolution times when introduced to a fluid capable of dissolving the tablet. In other embodiments, it may be preferable for a solid tablet to have a relatively low surface area to volume ratio to allow for longer dissolution times. In one or more embodiments, it may be desirable for the solid tablet to have a certain shape and size so that it compatibly fits, and may be disposed into, an internal cavity of a system, device, or apparatus using the solid tablet for a cleaning application.

Effervescing solid tablets disclosed herein may generally comprise one or more effervescing agents that effervesce when introduced to a fluid. In some embodiments, the effervescing agent may comprise an ingredient that reacts with a fluid to produce gas. For example, some effervescing agents may react with water to effervesce, including alkali metals, alkaline earth metals, carbides, hydrides, and anhydrides. In some embodiments, sodium hydride or butyllithium may be utilized as effervescing agents that react with water.

According to some embodiments, the effervescing agent may comprise two or more ingredients that react with one another to produce a gas, preferably when introduced to a fluid in which the tablet is soluble or reactive. For example, an effervescing agent may comprise ingredients such as the combination of one or more acids with one or more bases. When a water-soluble tablet comes into contact with an aqueous fluid and begins to dissolve, two reactive ingredients previously held in a mostly inert solid matrix of a tablet may react when introduced to an aqueous environment, and produce a gas. When this reaction occurs across the surface area of the tablet exposed to the aqueous fluid, it creates an effervescing effect that may aid in the dissolution of the tablet.

Examples of acidic ingredients that may be reacted with basic ingredients to produce effervescence in accordance with some embodiments include citric acid, hydrochloric acid, sulfuric acid, sulfurous acid, phosphoric acid, phosphorous acid, nitric acid, nitrous acid, hydrobromic acid, bromous acid, hydroiodic acid, perchloric acid, chloric acid, boric acid, acetic acid, formic acid, oxalic acid, pyruvic acid, malonic acid, malic acid, tartaric acid, propanoic acid, lactic acid, succinic acid, and carbonic acid. Examples of basic ingredients that may be reacted with acidic ingredients to produce effervescence in accordance with some embodiments include calcium carbonate, potassium carbonate, sodium carbonate, lithium hydroxide, sodium hydroxide, potassium hydroxide, calcium hydroxide, rubidium hydroxide, strontium hydroxide, rubidium hydroxide, cesium hydroxide, barium hydroxide, potassium tert-butoxide, pyridine, and triethylamine. According to some embodiments, the effervescing agent may comprise citric acid and sodium carbonate, the evolved effervescent gas being carbon dioxide.

According to some embodiments, a solid tablet may comprise a disintegrant or super-disintegrant. The disintegrant may, for example, cause the tablet (or portions thereof) to swell when introduced to the carrier fluid, such as in the case that the carrier fluid comprises water and/or when otherwise introduced to an aqueous environment. Capillary and/or wicking action of the carrier fluid through the tablet due to the disintegrant may, in some embodiments, speed tablet dissolution and/or provide for more efficient tablet dissolution (e.g., by increasing the rate of exposure of effervescing agents to the carrier fluid).

The amount of effervescing agent and/or disintegrant to add to a tablet may be chosen based on the desired performance of the tablet. For example, in some embodiments it may be desirable for a solid tablet to dissolve at a quicker rate, so more effervescing agent and/or disintegrant may be added to the solid. For example, it may be advantageous for a solid tablet to effervesce and dissolve within about thirty (30) minutes if cleaning applications require a more concentrated cleaning solution. In other embodiments, it may be advantageous for the tablet to last longer, for example several hours. In some embodiments, smaller amounts of effervescing agent and/or disintegrant may be added so that the solid tablet lasts for approximately four (4) hours. In some embodiments, sufficient effervescing agent and/or disintegrant may be utilized to enable the solid tablet to last approximately two (2) hours (or greater than two (2) hours).

The carrier fluid used to dissolve the solid tablet may be aqueous, organic, or may comprise any combination of aqueous and organic components. The carrier fluid may comprise a variety of solutes. In some embodiments, for example, an aqueous carrier fluid may comprise solutes such as ions, anions, acids, bases, salts and/or minerals, or other solutes that may naturally occur from a water source, or may be added by man. According to some embodiments, the carrier fluid may comprise tap water or well water and/or other filtered, treated, or untreated water supply.

In addition to an effervescing agent, effervescing solid tablets may also comprise one or more biofilm disruptors. A biofilm is residue consisting of organic and inorganic elements and compounds that naturally occur on surfaces that are exposed to moisture or other environmental exposures. For example, biofilm may comprise a layer of slime resultant from bacterial growth and waste products. Sometimes biofilms may further comprise a layer of inorganic salts and minerals deposited, for example, by hard water.

Biofilm disruptors may be used to effectively dissolve these organic and inorganic residues. Many different types of biofilm disruptors are known in the art, and may be used in solid tablets in accordance with embodiments described herein. Biofilm disruptors that may be utilized in effervescing solid tablets include (but are not limited to) acids, bases, organic and inorganic surfactants, polymers, film-forming ingredients, oxidizing agents, phosphate-containing ingredients, chlorine-containing ingredients, carbonates, and alkylalkoxylates. In some embodiments, a biofilm disruptor comprising a blend of silicate, a mixture of complex phosphate, concentrated organic chlorine, sodium carbonate, and an alkylalkoxylate may be used. In one or more embodiments, between eight and nine percent (8-9%) of the phosphate content of the biofilm disruptor may be expressed as phosphorus.

Effervescing solid tablets may also comprise one or more corrosion inhibitors. A corrosion inhibitor is a chemical compound that may be applied to a tube or header surface to decrease the corrosion rate of that tube material. The materials typically treated with corrosion inhibitors are metals and alloys, but other types of materials may also or alternatively be treated. Corrosion inhibitors can form a protective layer over the material to prevent corrosive agents from coming into contact with the surface. Corrosive inhibitors may also react with the corrosive agents themselves. Examples of corrosive inhibitors that may be used in effervescing solid tablets in accordance with some embodiments include, but are not limited to free radical scavengers, antioxidants, anodic inhibitors, cathodic inhibitors, tolytriazole, and sodium molybdate.

Some described embodiments of effervescing solid tablets have a particular application with systems for cleaning the interior of heat exchanger tubes to maintain operational efficiency. A common type of heat exchanger has a bundle of tubes fixed at opposite ends in headers. Typically, untreated cooling water flows through the interior of the tubes and exchanges heat with water or some other fluid, e.g., a gas, on the outside of the tubes which is at a different temperature than the fluid flowing on the inside of the tubes. As is well known, if the water flowing through the tubes is dirty or untreated or inadequately treated for minimizing precipitation of minerals, a mineral deposit and/or dirt will gradually accumulate on the inside of the tubes. In boiler tube operations, this mineral deposit is known generally as "boiler scale" and may comprise principally calcium and magnesium carbonate. Accumulated mineral and/or dirt in the tubes is generally removed by means of a tube cleaning machine propelling a rotating brush or other cleaning tool through each tube to dislodge the mineral and/or dirt, and carrying dislodged material away in a flow of pressurized cleaning water.

Referring now to FIG. 1, a block diagram of a tube cleaning system 100 for utilizing effervescing solid tablets according to some embodiments is shown. In some embodiments, the system 100 may comprise an effervescing solid tablet 102 that may be disposed in a tablet chamber 104 of the tube cleaning system 100. According to some embodiments, the tablet 102 may be formulated as described herein, e.g., by including at least one effervescing agent, a biofilm disrupter, and a corrosion inhibitor, that effervesce and dissolve, e.g., to make a "bubbly" cleaning solution. In some embodiments, the tablet chamber 104 may be operably coupled to a lid 106 for closing and sealing the tablet chamber 104. In some embodiments, the lid 106 may be coupled to the tablet chamber 104 with a conventional mechanism, e.g., a hinge and/or a bayonet-style connection (neither of which is explicitly shown in FIG. 1). According to some embodiments, the lid 106 may further be coupled to a seal (also not explicitly shown) on an open upper portion of the tablet chamber 104 (e.g., to prevent carrier fluid leakage during pressurized applications where pressurized carrier fluid (not shown) is introduced into the tablet chamber 104 with the tablet 102). In some embodiments, the lid 106 may removable. For example, a removable lid 106 may comprise a screw-on lid, cap, top, and/or other device having a threaded portion (not shown in FIG. 1) that mates and/or couples with a threaded receiving portion of the tablet chamber 104 (also not shown in FIG. 1). According to some embodiments, a removable lid 106 may comprise a plurality of cruciform portions (not shown in FIG. 1) forming an upper structure that is readily engageable by a human hand for easy tightening and/or loosening of the removable lid 106.

According to some embodiments, the tablet chamber 104 may be coupled to a fluid inlet 108 that introduces carrier fluid (not explicitly shown) into the tablet chamber 104 for dissolving the solid tablet 102. The tablet chamber 104 may also be coupled to a fluid outlet 112 for removing cleaning solution (e.g., a combination or mixture of carrier fluid and dissolved agents from the chemical tablet 102) from the tablet chamber 104, and into an effluent conduit 114. In some embodiments, the effluent conduit 114 may house or accept a flexible rotary tube cleaning drive shaft 116 and/or comprise or define an interior passage 118 for communicating the cleaning fluid out of the effluent conduit 114 and, e.g., into a tube (not shown) for cleaning. In some embodiments, a mechanical agitator 120, such as a rotating brush or other tool coupled to the drive shaft 116 may be utilized to effectuate mechanical cleaning of the tube. In some embodiments, the drive shaft 116 and/or the mechanical agitator 120 may be driven by a motor 122. Optionally, a check valve (not shown) for preventing backflow into the tablet chamber 104 may be disposed in the fluid outlet 112 or effluent conduit 114. In some embodiments, the tube cleaning system 100 may include a grate (not shown) disposed within the tablet chamber 104. In some embodiments, the tube cleaning system 100 further comprises an effervescing solid tablet dissolution indicator (not shown) in communication with the tablet chamber 104 for monitoring the progress of tablet dissolution during use.

Figure 2:
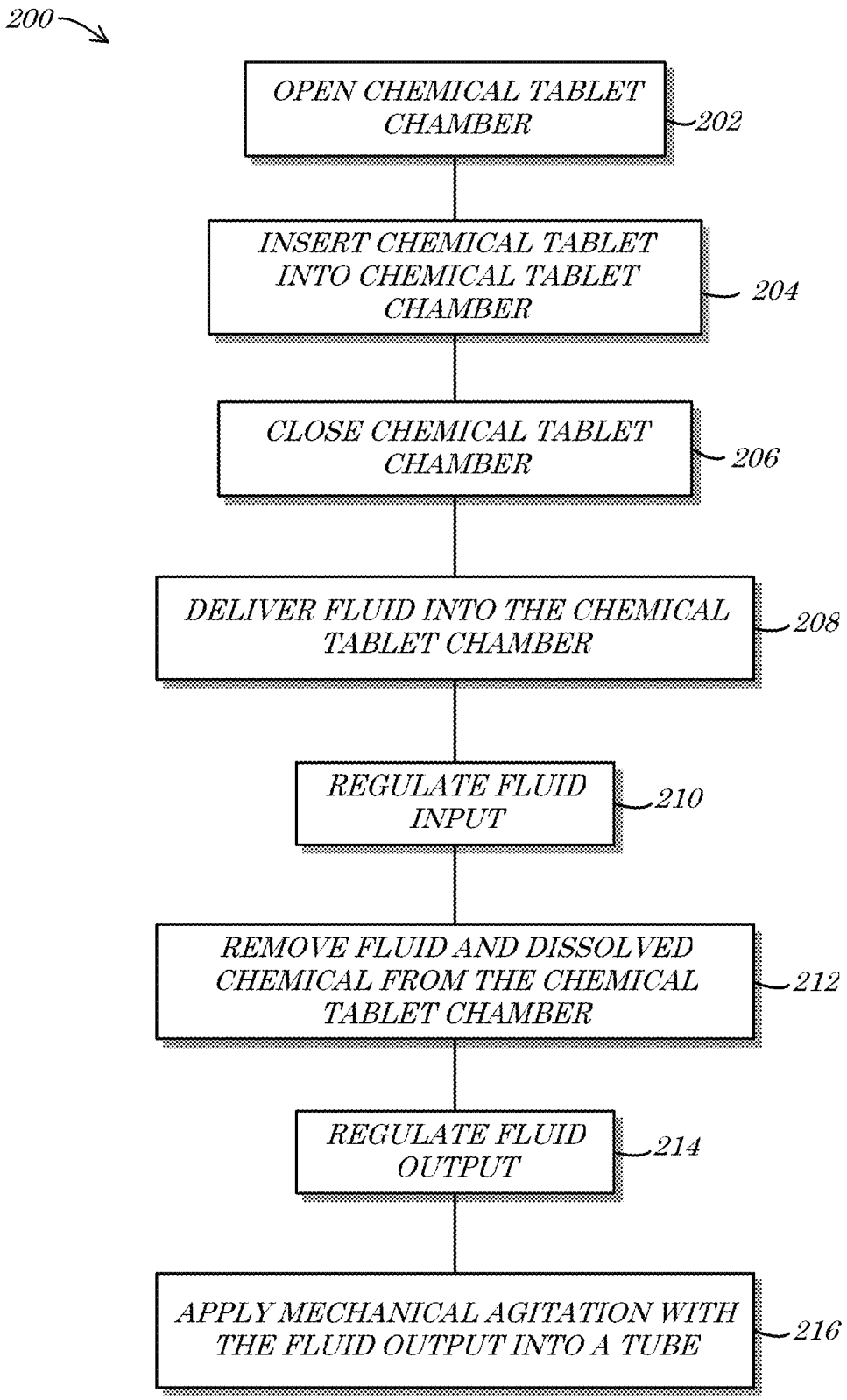
FIG. 2 is a flow diagram of a method according to some embodiments.

Referring now to FIG. 2, a flow diagram of a method 200 according to some embodiments is shown. The method 200 may, for example, comprise a method of utilizing an effervescing solid tablet (such as the tablet 102 of FIG. 1 herein) to provide a cleaning solution to a chiller tube. The process diagrams and flow diagrams described herein do not necessarily imply a fixed order to any depicted actions, steps, and/or procedures, and embodiments may generally be performed in any order that is practicable unless otherwise and specifically noted. While the order of actions, steps, and/or procedures described herein is generally not fixed, in some embodiments, actions, steps, and/or procedures may be specifically performed in the order listed, depicted, and/or described and/or may be performed in response to any previously listed, depicted, and/or described action, step, and/or procedure.

The method 200 may, in some embodiments, comprise opening a chemical tablet chamber (e.g., the tablet chamber 104 of FIG. 1 herein; e.g., of a tube cleaning system) at 202. In some embodiments, a solid chemical tablet may be disposed into an internal cavity of the chemical tablet chamber, at 204. This internal cavity may, for example, be defined by a housing of the chemical tablet chamber and/or tube cleaning system (e.g., as shown in FIG. 1). In some embodiments, the internal cavity may not be defined by the system housing, but rather by a separate canister, container, and/or casing coupled to the housing of the chemical tablet chamber and/or tube cleaning system. In some embodiments, the internal cavity may be partially defined by the system housing, and partially defined by a separable canister, container, and/or casing coupled to the system housing.

In some embodiments, the internal cavity of the chemical tablet chamber may optionally be closed, at 206. According to some embodiments, the internal cavity may be fully enclosed and/or sealed with a lid. In some embodiments, the internal cavity may be fully enclosed and sealed so that the chamber and any contents thereof (e.g., carrier fluid and/or the chemical tablet) may be pressurized. In some embodiments, the tube cleaning system may not have a lid, and may remain open while the system is in use (i.e., non-pressurized operation).

According to some embodiments, fluid flow may be delivered via an inlet and/or valve coupled to the internal cavity, at 208. As the introduced carrier fluid comes into contact with the solid tablet, the solid tablet may begin to effervesce and dissolve to form a cleaning solution. In some embodiments, the carrier fluid may be delivered to the internal cavity before the solid tablet is disposed into the cavity. In other embodiments, the solid tablet maybe deposited, closed and sealed within the internal cavity before the carrier fluid is delivered into the internal cavity. The carrier fluid flow/input may, according to some embodiments, be regulated to a desired flow rate and/or pressure within the closed internal cavity, at 210. For example, the carrier fluid may be delivered to any desired volume so that the solid tablet is either fully or partially submersed in the fluid. For example, it may be desirable to only partially submerge the solid tablet in carrier fluid to minimize exposure to the fluid and maximize the life of the tablet. In one or more embodiments, the pressure governing the fluid flow/input may be regulated to speed or slow the effervescence and dissolution of the solid tablet. According to some embodiments, as described herein, the chemical tablet may be formulated such that in a fully-submerged and/or pressurized fluid flow environment (e.g., inside the chemical chamber), the effective dissolution rate of the full tablet is greater than one (1) hour and/or approximately two (2) hours, e.g., at a flow rate of approximately three quarters of a gallon per minute (0.75 GPM) and/or between approximately fifty-five and sixty degrees Fahrenheit (55°-60° F.). Such a designed dissolution rate may, for example, be appropriate for commercial and/or industrial tube cleaning applications.

In some embodiments, the cleaning solution (i.e., fluid and dissolved portions of the chemical tablet), and/or a portion thereof, may be removed from the internal cavity via an outlet and/or valve coupled to the internal cavity, at 212. The outlet valve can optionally be controlled to regulate the flow rate of the fluid through, and out of, the tube cleaning system. The outlet valve can, in some embodiments, be regulated to achieve a desired dispensing pressure and/or dispensing rate, at 214, e.g., to maximize the performance of the tube cleaning system for a specific job/application. The outlet valve may optionally be coupled to a flexible conduit, optionally having means for mechanical agitation for communicating the passage of the cleaning fluid out of the tube cleaning system. Mechanical agitation may be applied in conjunction with the fluid output, for example, at 216, e.g., and into a tube for cleaning, and as described supra in regards to FIG. 1.

Figure 3:
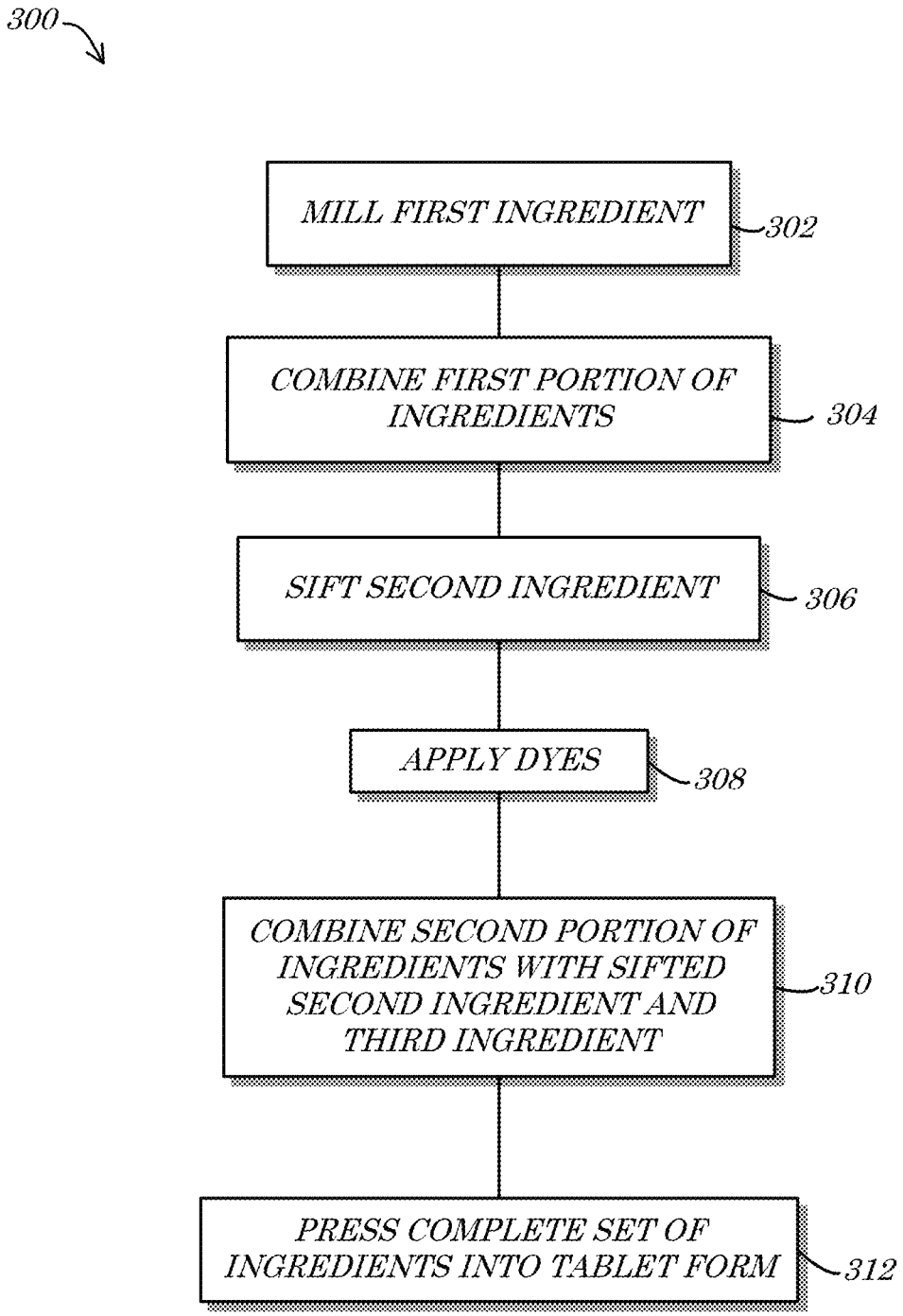
FIG. 3 is a flow diagram of a method according to some embodiments.

Referring now to FIG. 3, a flow diagram of a method 300 for forming an effervescent solid tablet according to some embodiments is shown (e.g., formulated as described herein). A person of ordinary skill in the art will realize that there are generally many ways to combine ingredients and to formulate a composition that may be pressed into tablet form. The method 300 represents a particular manner of formulation and combination of ingredients that has been developed and judged to be successful for combining the ingredients described herein in tablet form, and is not meant to limit any other ways of combining and formulating these or similar ingredients into a solid tablet form that is or becomes known or practicable. It is recognized that the ingredients discussed herein may be processed using different apparatuses and configurations of such apparatuses, and may be combined in different steps, or orders of steps.

In some embodiments, a first ingredient, such as tolytriazole, may be milled, at 302, optionally using a Comil® apparatus available from Quadro Engineering Corp. of Ontario, Canada. In some embodiments, the Comil® apparatus may be configured to mill the first ingredient/tolytriazole utilizing a 075 screen, a 200 spacer and/or a rolling speed of 90. In some embodiments, some or all of the ingredients, such as a first portion of the ingredients of the solid tablet, may be combined, at 304. For example, in some embodiments, sodium molybdate, the milled tolytriazole, a detergent (e.g., low-foaming and/or powdered), citric acid, sodium bicarbonate, a binder ingredient, adipic acid, and sodium carbonate (e.g., the first portion of the ingredients) may be combined and tumble blended for ten (10) minutes. In some embodiments, a second ingredient such as stearic acid, may optionally be passed (e.g., sifted) through a sixteen (16) mesh, at 306. In some embodiments, one or more dyes may be applied, at 308. The combined first portion of ingredients may be dyed, such as by combining a predetermined amount of the first portion of ingredients (such as ten pounds (10 lbs) thereof) with predetermined amounts of dye ingredients, e.g., defining a second portion of the ingredients. According to some embodiments, the dye(s) and the predetermined amount of the first portion of ingredients may be milled, e.g., via a Comil® utilizing a 075 screen and 200 spacer. In some embodiments, the second portion of the ingredients may be combined with the sifted second ingredient and a third ingredient (such as a super disintegrant), at 310, e.g., defining a complete set of ingredients for the chemical tablet. According to some embodiments, the combining at 310 may comprise tumble blending the complete set of ingredients for a predetermined amount of time, e.g., ten (10) minutes. In some embodiments, the mixture of the complete set of ingredients may then be pressed into tablet form ("tabeltized" or "tableted"), at 312. The complete set of ingredients may be pressed in a hydraulic press apparatus, for example, under approximately forty (40) tons of compressive force.

According to some embodiments, the tabletization process may be performed in a low moisture and/or low humidity environment to prevent early or undue reaction of the citric acid and sodium carbonate. In some embodiments, the chemical tablets may be sealed to reduce the likelihood of moisture causing a reaction between the citric acid and sodium carbonate prior to the chemical tablet being exposed to fluid in an operational environment. In some embodiments, a desiccant may be utilized (e.g., packaged with the chemical tablet) to further reduce the likelihood that moisture may degrade the chemical tablet prior to operational use.

From the foregoing disclosure, it will be apparent that there are provided novel formulations, systems and methods for cleaning heat-exchanging systems comprising a plurality of fluid conveying tubes. Variations and modifications of the herein described formulations, systems and methods in accordance with the disclosed embodiments will undoubtedly suggest themselves to one of ordinary skill in this art. Thus, the foregoing description should be taken as illustrative and not in a limiting sense. Some of these embodiments may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

In some embodiments, a tube cleaning system may comprise one or more of: (i) a housing defining a tablet chamber having an opening, the tablet chamber being configured to receive an effervescing solid tablet comprising at least one effervescing agent that effervesces in an aqueous environment, at least one biofilm disrupter, and at least one corrosion inhibitor, (ii) a carrier fluid inlet coupled to deliver a fluid flow into the tablet chamber, (iii) a fluid outlet coupled to remove the fluid flow from the tablet chamber, (iv) a lid coupled to the housing and selectively sealing the tablet chamber, (v) an effluent conduit coupled to the fluid outlet to receive fluid flow from the fluid outlet, (vi) a check valve disposed in one of the fluid outlet and the effluent conduit, (vii) an effervescing solid tablet dissolution indicator coupled to the tablet chamber, (viii) a mechanical agitator comprising a drive motor coupled to a rotary flexible tube cleaning drive shaft disposed in the effluent conduit, (ix) a pressure gage coupled to the tablet chamber to sense a pressure therein, and/or (x) a grate disposed within the tablet chamber.

According to some embodiments, the lid may comprise (i) a screw-on lid that is coupled to the housing via screw threads or (ii) a bayonet-style lid coupled to the housing via a biased engagement of one or more locking lugs of the lid and one or more retaining clips of the housing. In some embodiments, biasing engagement may be provided by a biasing element disposed within the tablet chamber between the lid and an effervescing solid tablet disposed within the tablet chamber. In some embodiments, the lid may be coupled to the housing by a hinge and may be moveable in accordance with the hinge to selectively cover or uncover the tablet chamber. In some embodiments, the fluid flow into the tablet chamber may be pressurized. According to some embodiments, the effervescing solid tablet dissolution indicator coupled to the tablet chamber may comprise a window coupled to the tablet chamber to permit visual inspection of the contents thereof. In some embodiments, the window may comprise a magnifier. According to some embodiments, the system may comprise the effervescing solid tablet.

In some embodiments, a process for utilizing an effervescing solid tablet, may comprise: (i) disposing a tablet in a tablet chamber, the tablet comprising at least one effervescing agent that effervesces in an aqueous environment, at least one biofilm disrupter, and at least one corrosion inhibitor, (ii) delivering a carrier fluid into the tablet chamber through a carrier fluid inlet, thereby causing the tablet to effervesce and dissolve to form a cleaning fluid, (iii) removing the cleaning fluid from the tablet chamber through a fluid outlet, and (iv) dispensing the cleaning fluid onto a surface to be cleaned. According to some embodiments, the process may further comprise (v) closing the tablet chamber via a lid, (vi) regulating pressure inside of the tablet chamber, (vii) regulating a rate of fluid delivery into the tablet chamber, (viii) regulating a rate of removal of the cleaning fluid from the tablet chamber, and (ix) regulating a pressure of dispensing the cleaning fluid. In some embodiments, the tablet may partially or fully dissolve within the tablet chamber. In some embodiments, the tablet may fully dissolve within between thirty minutes and four hours. In some embodiments, the tablet may fully dissolve within between one hour and three hours. In some embodiments, the tablet may fully dissolve within about two hours.

According to some embodiments, a process for forming an effervescing solid tablet may comprise: (i) processing amounts of ingredients including at least one effervescing agent, at least one biofilm disrupter, and at least one corrosion inhibitor, (ii) combining the ingredients, and (iii) compressing the combined ingredients to form the effervescing solid tablet. In some embodiments, the processing of the ingredients may comprise one or more of (a) milling the ingredients and (b) screening the ingredients. In some embodiments, the processing may occur before the combining. According to some embodiments, the processing may occur after the combining.

What is claimed is:

1. A tube cleaning system, comprising:

a housing defining a tablet chamber having an opening;

an effervescing solid tablet disposed within the tablet chamber, the effervescing solid tablet comprising a mixture of ingredients pressed together in a uniform solid form, the mixture of ingredients comprising at least one effervescing agent that effervesces in an aqueous environment, at least one biofilm disrupter, and at least one corrosion inhibitor;

a carrier fluid inlet coupled to deliver a fluid flow into the tablet chamber;

a fluid outlet coupled to remove the fluid flow from the tablet chamber;

a lid coupled to the housing and selectively sealing the opening of the tablet chamber;

an effluent conduit coupled to the fluid outlet to receive fluid flow from the fluid outlet;

a check valve disposed in one of the fluid outlet and the effluent conduit;

an effervescing solid tablet dissolution indicator coupled to the tablet chamber; and a mechanical agitator comprising a drive motor coupled to a rotary flexible tube cleaning drive shaft disposed in the effluent conduit.

2. The system of claim 1, wherein the at least one effervescing agent of the effervescing solid tablet comprises a mixture of sodium carbonate and at least one of citric acid and adipic acid.

3. The system of claim 2, wherein the at least one biofilm disrupter of the effervescing solid tablet is selected from the group consisting of a polymer, a film-forming ingredient, an oxidizing agent, a phosphate-containing ingredient, and combinations thereof.

4. The system of claim 2, wherein the at least one corrosion inhibitor of the effervescing solid tablet is selected from the group consisting of a free radical scavenger, an antioxidant, an anodic inhibitor, and a cathodic inhibitor.

5. The system of claim 2, wherein the at least one corrosion inhibitor of the effervescing solid tablet comprises at least one of tolytriazole and sodium molybdate.

6. The system of claim 2, wherein the amount of the at least one effervescing agent in the effervescing solid tablet causes the effervescing solid tablet, when introduced to the carrier fluid, to effervesce and dissolve in not less than thirty minutes.

7. The system of claim 6, wherein the amount of the at least one effervescing agent in the effervescing solid tablet causes the effervescing solid tablet, when introduced to the carrier fluid, to effervesce and dissolve in not less than two hours.

8. The system of claim 1, wherein the effervescing solid tablet dissolution indicator comprises a magnified window disposed in the lid.

9. A tube cleaning system, comprising:

a housing defining a tablet chamber having an opening;

a solid tablet disposed within the tablet chamber, the solid tablet comprising a mixture of ingredients pressed together in a uniform solid form, the mixture of ingredients comprising at least one biofilm disrupter and at least one corrosion inhibitor;

a carrier fluid inlet coupled to deliver a fluid flow into the tablet chamber;

a fluid outlet coupled to remove the fluid flow from the tablet chamber;

a lid coupled to the housing and selectively sealing the opening of the tablet chamber;

an effluent conduit coupled to the fluid outlet to receive fluid flow from the fluid outlet;

a solid tablet dissolution indicator coupled to the tablet chamber; and a mechanical agitator comprising a drive motor coupled to a rotary flexible tube cleaning drive shaft disposed in the effluent conduit.

10. The system of claim 9, wherein the at least one biofilm disrupter of the solid tablet is selected from the group consisting of a polymer, a film-forming ingredient, an oxidizing agent, a phosphate-containing ingredient, and combinations thereof.

11. The system of claim 9, wherein the at least one corrosion inhibitor of the solid tablet is selected from the group consisting of a free radical scavenger, an antioxidant, an anodic inhibitor, and a cathodic inhibitor.

12. The system of claim 9, wherein the at least one corrosion inhibitor of the solid tablet comprises at least one of tolytriazole and sodium molybdate.

13. The system of claim 9, wherein the mixture of ingredients further comprises at least one effervescing agent comprising a mixture of sodium carbonate and at least one of citric acid and adipic acid.

14. The system of claim 13, wherein the amount of the at least one effervescing agent in the solid tablet causes the solid tablet, when introduced to a carrier fluid, to effervesce and dissolve in not less than thirty minutes.

15. The system of claim 14, wherein the amount of the at least one effervescing agent in the solid tablet causes the solid tablet, when introduced to the carrier fluid, to effervesce and dissolve in not less than two hours.

16. The system of claim 9, wherein the mixture of ingredients further comprises at least one disintegrant.

17. The system of claim 16, wherein the amount of the at least one disintegrant in the solid tablet causes the solid tablet, when introduced to a carrier fluid, to swell and dissolve in not less than thirty minutes.

18. The system of claim 17, wherein the amount of the at least one disintegrant in the solid tablet causes the solid tablet, when introduced to the carrier fluid, to swell and dissolve in not less than two hours.

19. The system of claim 9, wherein the mixture of ingredients further comprises at least one acid and at least one base and wherein the fluid flow comprises a flow of a carrier fluid that acts as a catalyst to a reaction of the at least one acid with the at least one base.

20. The system of claim 9, wherein the solid tablet dissolution indicator comprises a magnified window disposed in the lid.

* * * * *